United States Patent [19]

Bohan, Jr. et al.

[11] Patent Number: 4,527,085

[45] Date of Patent: Jul. 2, 1985

[54] HIGH VOLTAGE SPARK ELECTRODE STRUCTURE

[75] Inventors: John E. Bohan, Jr., Minneapolis; Ulrich Bonne, Hopkins; Dane M. Weber, Coon Rapids, all of Minn.

[73] Assignee: Honeywell Inc., Minneapolis, Minn.

[21] Appl. No.: 468,265

[22] Filed: Feb. 22, 1983

[51] Int. Cl.[3] ..... H01T 13/04; F23Q 3/00; F23Q 3/70

[52] U.S. Cl. ..... 313/128; 313/141; 361/253; 431/258

[58] Field of Search ..... 313/141, 128; 361/253; 431/258

[56] References Cited

U.S. PATENT DOCUMENTS 2,715,200 8/1955 Flynn ..... 361/253
3,505,568 4/1970 Flynn ..... 361/253
4,238,184 12/1980 Schilling ..... 431/59
4,433,266 2/1984 Riehl ..... 361/253 X

OTHER PUBLICATIONS

Honeywell Product Sheet—"Q347 Single Electrode Igniter-Sensor for S87 Direct Spark Ignition Systems'-'—Form No. 60-1018.

*Primary Examiner*—Palmer Demeo
*Assistant Examiner*—Sandra L. O'Shea
*Attorney, Agent, or Firm*—Alfred N. Feldman

[57] ABSTRACT

With the addition of a conductive means in the form of a grounded ring or member placed at the insulator means of a high voltage spark electrode structure, the required break down voltage of the spark gap can be reduced. The conductive means typically would be a ring encircling the insulator means of the electrode structure and would provide a ground as well as a mechanical support near the end of the insulator means of the electrode structure.

6 Claims, 4 Drawing Figures

HIGH VOLTAGE SPARK ELECTRODE STRUCTURE

BACKGROUND OF THE INVENTION

The ignition of gaseous fuels, particularly in residential furnaces, have undergone extensive changes in order to improve efficiency. One major change that is currently underway is the replacement of a standing ignited pilot with some other type of ignition source. One of the more common ignition sources is a spark gap supplied with a high voltage to initiate a spark to ignite the gaseous fuel. This type of system is deemed to be fuel efficient in that fuel is consumed only when a demand for heat is placed on the heating system.

The application of a spark gap as an ignition source to a gaseous fuel has been well recognized for many years, but was not used extensively as the generation of a spark across the gap created many more problems than using a standing pilot as an ignition source. With the advent of the removal of the standing pilot as an efficient ignition source, the introduction of spark ignition has become widespread. With this comes certain types of installation and operating problems. The high voltage involved in generating a spark across a spark gap can create radio frequency interference, and has the potential for installation and service problems in handling the very high voltages involved. Typically, the voltage utilized in spark ignition systems for ignition of gaseous fuels is in the 12,000 to 16,000 volt range. At these voltages, voltage break down of conductor insulation, and voltage break down to unrelated surfaces can be a problem. Also, as previously noted, radio frequency interference is generated by the spark. It is desirable to lower the spark voltage as far as practical and still supply a reliable spark intensity across a gap that is not likely to be inadvertently bridged.

SUMMARY OF THE INVENTION

It has been found that in certain types of spark ignition systems that the voltage required for break down of a spark gap can be reduced from the 12,000 to 16,000 volt range to an 8,000 to 9,000 volt range with a spark gap of the same physical dimensions as was previously required at the higher voltages. The improvement in operating characteristics is accomplished by providing a grounding ring or conductor at the spark gap insulator as close to the electrode as possible. It has been found that by moving a ground along the insulator of a spark gap, the voltage required to break down the gap can be reduced progressively as the ground is moved toward the spark gap. This type of arrangement occurs in systems which rely on a single rod spark ignitor that is also used for flame sensing with a low voltage circuit that includes a voltage break down device. This overall type of system is disclosed in U.S. Pat. No. 4,238,184.

It has been found that the voltage break down can be improved in the type of system disclosed in U.S. Pat. No. 4,238,184 by the addition of a grounded element being placed at or around the insulator as close to the spark gap as possible. The limitation as to the placement of the ground is the tenancy of the device to break over from the electrode to the added ground. As such, the improvement in voltage characteristics is limited by how close the ground is placed to the electrode.

DESCRIPTION OF THE PREFERRED EMBODIMENT

Figure 1:
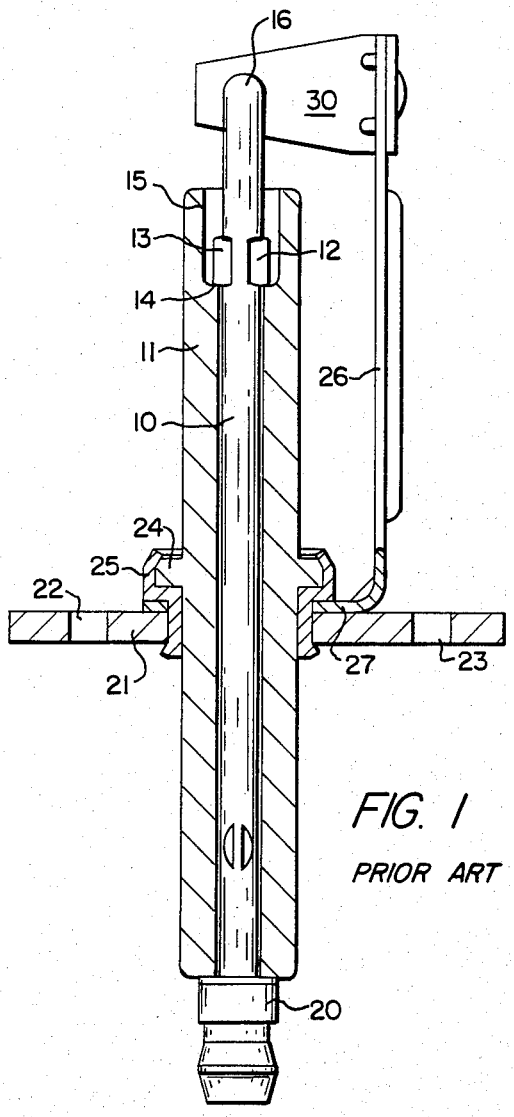
FIG. 1 PRIOR ART
FIG. 1 is an elevation of a prior art electrode structure.

In FIG. 1 an elevation of a prior art electrode structure is disclosed. A spark electrode 10, in the form of a rod, is placed in the center of an insulator means 11. The electrode 10 has flattened portions 12 and 13 that abut at 14 a recess 15 in the insulator means 11. The spark electrode 10 has a rounded configuration and an end 16 which forms a first side of a spark gap. The electrode 10 has a terminal 20 that is attached to the end of the electrode 10 opposite from the end 16, and holds the electrode 10 in a frictional engagement against the abutment 14 of the insulator means 11.

The electrode 10 and its associated insulator means 11 is held on a mounting means 21 that is shown as a flat plate having a pair of holes 22 and 23 that are used to mount the structure on a surface that forms the ground of the system, and in effect is the second side of the spark gap. Typically, the mounting means 21 would be mounted on a burner which would be grounded, and would hold the end 16 of the electrode 10 in position to ignite and subsequently sense the existence of a flame. The insulator means 11 has an annular projection 24 that is formed integral to the insulator means 11 and is held in a ring 25 into the mounting means 21 to rigidly attach the electrode structure to the mounting means 21.

The electrode structure is completed by a bracket 26 that is attached at 27 by the ring 25 into the mounting means 21. The bracket 26 has a flat projecting end 30 that cooperates with the end 16 of the spark electrode 10 to form the actual spark gap across which a spark is generated for ignition of a fuel. The prior art electrode structure disclosed in FIG. 1 typically would be mounted on a gaseous fuel burner and would utilize a voltage of between 12,000 and 16,000 volts connected between the terminal 20 and ground or the mounting means 21. This voltage would break down the air gap created between the member 30 and the end 16 of the electrode 10.

Figure 2:
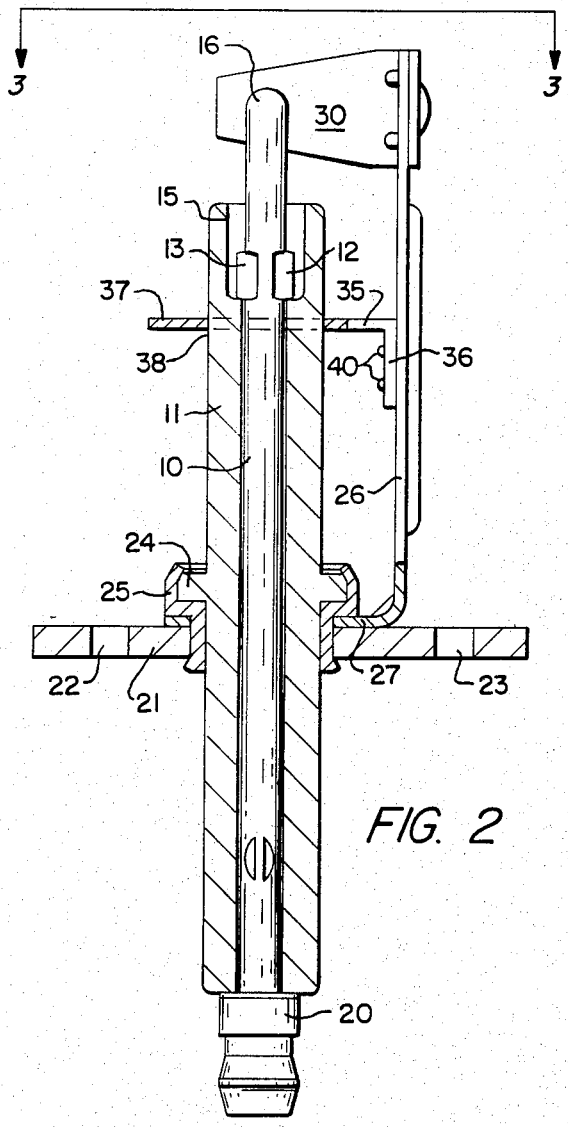
FIG. 2 is an elevation of the novel electrode structure.

The novel high voltage spark electrode structure of the present invention is disclosed in FIG. 2 encompassed in a structure similar to that of FIG. 1. All the similar or common parts will be labeled with the same reference numbers and will not be repeated at this point. The electrode structure has a conductive means 35 made up of an L-shaped structure including a base leg 36 and an extended leg 37. The extended leg 37 has a hole at 38 that encircles the insulator means 11. The conductive means 35 is riveted or otherwise attached at 40 to the bracket 26. The conductive means 35 places an electrical ground around the insulator means 11 that is spaced from the spark gap of the device at a sufficient distance so that a voltage does not break down between the electrode 10 and the conductive means 35. The conductive means 35, however, is placed as close to the electrode 10 as is possible. The placement of the conductive means 35 at the location disclosed has been found to reduce the required break down potential to approximately 8,000 to 9,000 volts or roughly a reduction of one-third of the potential otherwise required to properly operate the electrode structure. The reason for this reduction in voltage will be discussed after the circuit of FIG. 4 has been explained.

Figure 3:
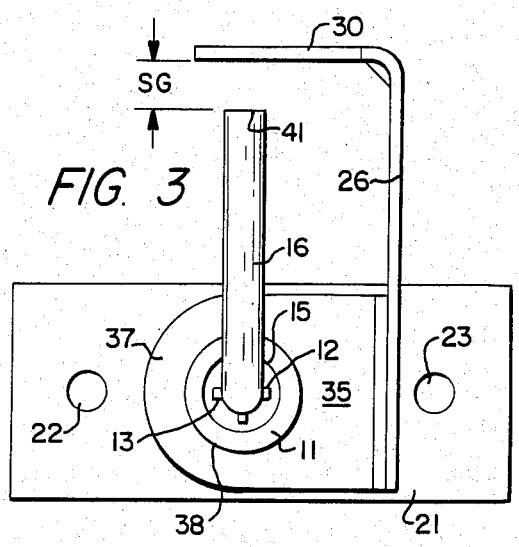
FIG. 3 is an end view of the device of FIG. 2 along lines 3—3 of FIG. 2.

In FIG. 3 an end view of the electrode structure of FIG. 2 is disclosed along lines 3—3. It will be seen that the end 16 of the electrode 10 is an elongated portion of the electrode 10 having an end 41 that approaches the member 30, and the spark gap for the electrode structure has been identified as a gap SG being about 0.16 inches. The mounting means 21 can be more clearly seen as being substantially a plate including the two holes 22 and 23 for mounting this device on a burner. Also, the conductive means 35 is readily seen as a flat surface having a hole 38 that encircles the insulator means 11 thereby providing the novel function plus adding mechanical support to the insulator means 11.

Figure 4:
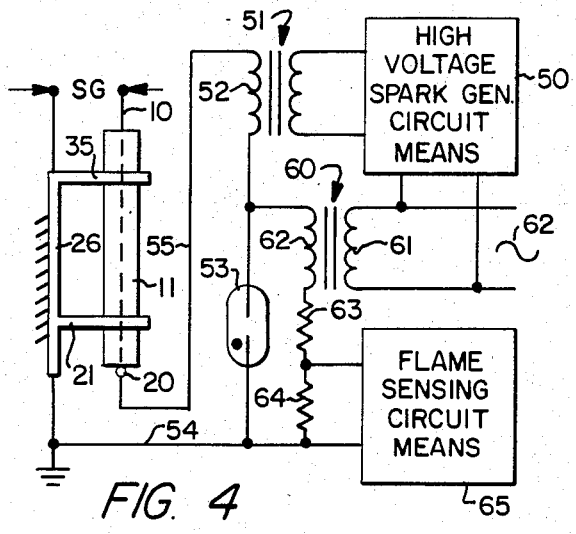
FIG. 4 is a circuit schematic of a circuit utilizing the novel electrode structure.

In FIG. 4 a schematic representation of the novel high voltage spark electrode structure is disclosed in a circuit of the type previously mentioned as being disclosed in U.S. Pat. No. 4,238,184. A high voltage spark generating circuit means 50 is disclosed having a step-up transformer 51 that provides a high voltage at the winding 52. The winding 52 is connected through a voltage break down means 53 that is disclosed as a gas tube. The gas tube in turn is then connected to a conductor 54 that is ground for the system and typically would be one side of a fuel burner. The high voltage winding 52 is also shown as connected to a conductor 55 that is in turn connected to the terminal 20 of a high voltage spark electrode structure including the electrode 10 and the insulator means 11. The mounting means is schematically shown at 21 for the electrode structure and the spark gas SG is disclosed between the electrode 10 and ground 54. The conductive means 35 is again disclosed encircling the insulator means 11 and spaced sufficiently distant from the electrode 10 to prevent a break down between the conductive means 35 and the electrode 10.

The circuit of FIG. 4 is completed by a second transformer 60 having a primary winding 61 connected to a source of potential 62 that supplies potential to the high voltage spark generating circuit means 50 and to a secondary winding 62 that is connected in series with a pair of resistors 63 and 64 across the voltage break down means or gas tube 53. A flame sensing circuit means 65 is shown connected across the resistor 64.

The circuit of FIG. 4 operates by applying a high voltage across the winding 52 and this voltage immediately breaks down the gap in tube 53 to apply a spark potential between the spark electrode 10 and the ground conductor 54. The voltage break down means 53 allows the high potential to be shunted in a manner so that this potential does not interfere with the operation of the flame sensing circuit means 65.

As soon as a flame is sensed across the spark gap SG (it's presence is sensed by a flame rectification principle) current is drawn through the resistors 63 and 64 so that the flame sensing circuit can monitor the existence of flame. At this same time the high voltage spark generating circuit means 50 is deactivated to remove the sparking potential so that the flame sensing circuit means can continue to monitor the existence of flame across the spark gap SG.

The circuit of FIG. 4 typically would operate with a spark voltage in the 12,000 to 16,000 volt range. With the addition of the conductive means 35, which is grounded, the potential required to break down the spark gap SG is lowered to the 8,000 to 9,000 volt range. This reduces the high voltage required in the entire system and significantly lessens the problems with inadvertent break down of components and other types of malfunctions and problems that relate to high voltage spark ignition.

The reason for the lowered voltage operating point for the spark gap SG is believed to be interrelated to the type of high voltage spark generating means involved, including the high voltage transformer 52 and the voltage break down means 53 in series with the high voltage of the winding 52. It is believed that prior to an actual break down of the spark gap SG, some form of ionization occurs and that some level of current starts to flow in the high voltage circuitry. This current is believed to be tuned in some type of resonant or "ringing" fashion so that an oscillation is generated which reinforces the break down potential and lessens the magnitude of voltage required to create a voltage break down and a spark across the gap SG. The conductive means 35 is believed to create that tuning, and has been experimentally found to be improved in function the closer the conductor means 35 can be placed to the spark electrode 10.

As will be noted in FIG. 2, the insulator means 11 has a recess 15. If the recess 15 is deepened, the over-the-surface distance between the conductive means 35 and the spark electrode 10 can be increased thereby allowing the conductive means 35 to be moved even closer to the spark gap SG thereby reducing the required break down voltage. Due to the very brittle nature of the typical insulator means 11, the amount that the recess 10 can be enlarged is limited. The optimum dimensions of the electrode structure therefore vary extensively with the type of material out of which the insulator means 11 is formed and the configuration of the recess 15. These parameters can be changed extensively and will effect the size of the spark gap and ultimately the voltage required to break down and cause a spark across the spark gap SG.

In view of the fact that the parameters of the present invention can be varied extensively, dependent upon the materials, the fuel, and the voltages involved, the scope of the present invention is limited solely by the scope of the appended claims.

The embodiments of the invention in which an exclusive property or right is claimed are defined as follows:

1. A high voltage spark electrode structure connected to high voltage spark generating circuit means which includes a high voltage source and a series connected voltage break down device, including: a spark electrode adapted to be connected to said spark generating circuit means; insulator means being continuous in length and enclosing a portion of said spark electrode with said insulator means leaving an end portion of said electrode exposed to form one side of a spark gap; conductive mounting means attached to said insulator means remote from said exposed electrode with part of said mounting means forming a second side of said spark gap; said mounting means adapted to mount said electrode structure on a surface that is at an electrical potential different than said spark electrode; and conductive means having a small cross section connected to said second side of said spark gap; said conductive means mounted adjacent said insulator means and spaced from said spark electrode; said conductive means being sufficiently spaced from said electrode to prevent arcing to said conductive means from said spark electrode while reducing the magnitude of said high voltage source of voltage to less than said 10,000 volts to create sparking across said spark gap.

2. A high voltage spark electrode structure as described in claim 1 wherein said conductive means includes a portion defining an opening and said opening at least partially encircling said insulator means.

3. A high voltage spark electrode structure as described in claim 2 wherein said opening is a hole and said hole completely encircles said insulator means.

4. A high voltage spark electrode structure as described in claim 3 wherein said conductive means is rigidly attached to said surface and encircling said insulator means to add rigidity to said electrode structure.

5. A high voltage spark electrode structure as described in claim 2 wherein said insulator means is recessed along said spark electrode at said portion of said electrode that forms said first side of said spark gap to increase an over-the-surface voltage break down distance between said conductive means and said spark electrode.

6. A high voltage spark electrode structure as described in claim 4 wherein said insulator means is recessed along said spark electrode at said portion of said electrode that forms said first side of said spark gap to increase an over-the-surface voltage break down distance between said conductive means and said spark electrode.

* * * * *